United States Patent [19]

Lavoine et al.

[11] Patent Number: 4,881,281

[45] Date of Patent: Nov. 21, 1989

[54] BATHING DEVICE, IN PARTICULAR FOR BATHING BABIES

[75] Inventors: Jean-Claude Lavoine, 14 rue de la République, 77590 Bois-le-Roi; Arsène Guedaguian, Neuilly-Plaisance, both of France

[73] Assignee: Jean-Claude Lavoine, France

[21] Appl. No.: 224,878

[22] PCT Filed: Oct. 19, 1987

[86] PCT No.: PCT/FR87/00407

§ 371 Date: Jun. 17, 1988

§ 102(e) Date: Jun. 17, 1988

[87] PCT Pub. No.: WO88/03000

PCT Pub. Date: May 5, 1988

[30] Foreign Application Priority Data

Oct. 22, 1987 [FR] France ..... 86 14648

[51] Int. Cl.[4] ..... A47K 3/024

[52] U.S. Cl. ..... 4/572; 4/659

[58] Field of Search ..... 4/564, 571, 572, 586, 4/587, 588, 639, 641, 659, 654, 655, 656, 657, 519, 584, 539, 553, 589; 128/365–371; 68/232, 233, 195

[56] References Cited

U.S. PATENT DOCUMENTS

| | | | |
|---|---|---|---|
| 1,086,628 | 2/1914 | Tate | 4/572 |
| 2,460,308 | 2/1949 | Pribil | 4/572 |
| 2,591,467 | 4/1952 | Rodefer | 4/656 |
| 2,724,839 | 11/1955 | Kennedy | 4/572 |
| 2,760,208 | 8/1956 | Mussells | 4/572 |
| 4,028,751 | 6/1977 | Moran | 4/173 |
| 4,373,221 | 2/1983 | Wilson | 4/559 |
| 4,651,361 | 3/1987 | Nolan | 4/519 |

FOREIGN PATENT DOCUMENTS

| | | | |
|---|---|---|---|
| 161176 | 2/1904 | Fed. Rep. of Germany . | |
| 665600 | 9/1938 | Fed. Rep. of Germany | 4/572 |
| 2179287 | 11/1973 | France . | |
| 126908 | 4/1947 | Sweden | 4/572 |
| 483244 | 12/1969 | Switzerland . | |
| 1370610 | 10/1974 | United Kingdom . | |

OTHER PUBLICATIONS

UK Patent Application 2,053,673, published 2/11/81, inventor–Fleury, see FIGS. 1–3.

*Primary Examiner*—Henry J. Recla
*Assistant Examiner*—Edward C. Donovan
*Attorney, Agent, or Firm*—Griffin, Branigan & Butler

[57] ABSTRACT

The device according to the invention comprises a receptacle 1 having a side wall 2 with facing wall portions thereof being at different distances apart and delimiting an internal periphery of the receptacle, the device is characterized in that it further comprises a platform 8 including a perforated bottom 9 and having an external periphery which fits inside the internal periphery of the receptacle and which has portions that are complementary thereto, and in that the platform includes lifting means 16.

12 Claims, 1 Drawing Sheet

BATHING DEVICE, IN PARTICULAR FOR BATHING BABIES

The present invention relates to a bathing device, in particular for bathing babies.

It is common practice, when bathing a baby, to wet the baby, to apply soap, and then to rinse it off. While applying soap, it is desirable for the baby to be out of the water, and this generally means that it is necessary to have both a small bathtub in which the baby can be dipped and an adjacent surface on which the baby is placed when being soaped. This arrangement suffers from several drawbacks: firstly, it is necessary to have enough room to be able to place the bathtub and the surface on which the baby is soaped side-by-side, secondly, the water remaining on the baby's body wets the soaping surface, and finally, it is difficult to manipulate a soap-covered baby and there is therefore a danger of the baby being banged accidentally on being moved.

An object of the present invention is to provide a bathing device, in particular for bathing babies, which makes it possible to bath a baby in a small space with maximum comfort both for the baby and for the person looking after the baby.

This object is achieved, according to the present invention, by a bathing device comprising a receptacle including a side wall having facing wall portions at different distances apart and delimiting an internal receptacle periphery, the device being characterized in that it further comprises a platform including a perforated bottom and having an external periphery which fits inside the internal periphery of the receptacle, and which includes portions that are complementary thereto, and in that the platform includes lifting means.

Thus, the platform on which the baby is placed is easily immersed by causing the complementary portions of the internal periphery of the receptacle and the external periphery of the perforated platform to coincide. In contrast, when the baby is to be soaped, it suffices to raise the platform by using the lifting means and to offset the platform slightly relative to the receptacle when the platform is in the raised position in order to cause the wide portions of the platforms to coincide with the more closely-spaced together portions of the side wall of the receptacle so that the platform is then held by the top edge of the receptacle with the water that runs off the baby's body then returning to the receptacle through the perforated holes in the platform.

According to an advantageous version of the invention, the side wall of the receptacle includes guide grooves, and the platform includes projecting members disposed to engage in the guide grooves. Thus, when the platform is immersed, unwanted displacement thereof within the receptacle is avoided.

In a particular embodiment of the invention, the guide grooves include support notches extending laterally from one of the sides of each of the guide grooves. Thus, the members projecting from the platform may be engaged in the supporting notches at different levels as a function of the desired degree of immersion.

According to another advantageous aspect of the invention, the side wall has a top edge including lock notches and the projecting members of the platform include lock ribs disposed to engage in the lock notches. Thus, when the platform is in its raised position it is held in a stable position relative to the receptacle even if a force is applied thereto by the baby moving.

Other characteristics and advantages of the invention appear from reading the following description with reference to the accompanying drawing, in which.

Figures 1, 2, 3, 4:
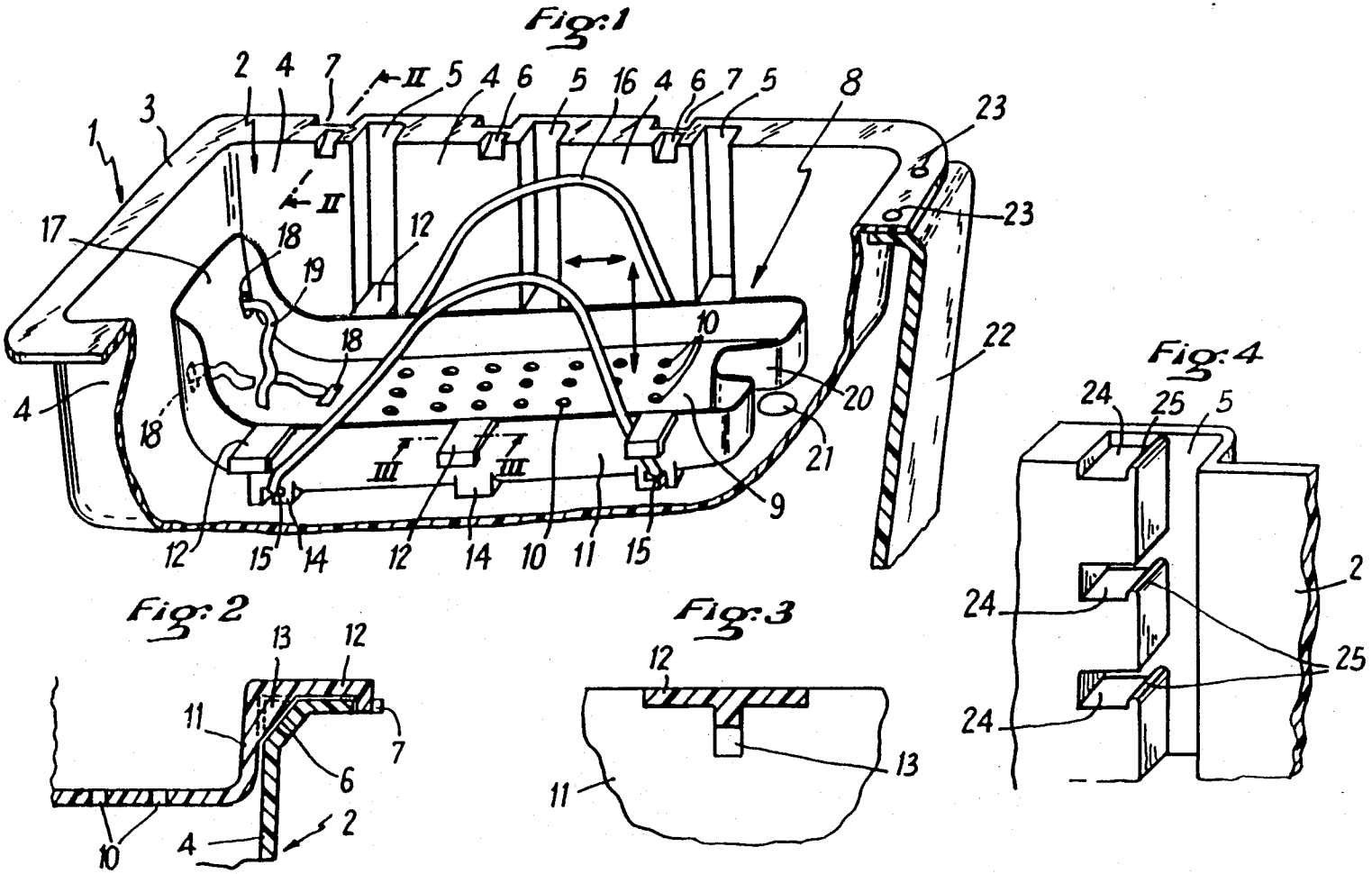
FIG. 1 is a partially cut-away perspective view of a device in accordance with the invention.
FIG. 2 is a section on a line II—II of FIG. 1 showing a detail on a larger scale.
FIG. 3 is a section view on a line III—III of FIG. 1 showing a detail on a larger scale.
FIG. 4 is a fragmentary perspective view showing a variant embodiment of the invention.

With reference to the figures, the bathing device in accordance with the invention comprises a receptacle, given an overall reference 1, which includes a side wall 2 delimiting an internal periphery of the receptacle and provided at its top with a horizontal rim 3.

In the embodiment shown, the ends of the side wall 2 are substantially plane. Its sides also include substantially plane wall portions 4 which are interconnected by channel section portions 5 constituting guide grooves. The bottoms of the guide grooves (i.e. taken in the transverse direction) are set back from the wall portions 4 such that facing portions of the longitudinal sides of the receptacle side wall are at different spacings.

Adjacent to the guide grooves 5, the top edge of the side wall 2 includes lock notches 6 which, when seen in cross-section (FIG. 2) are triangular in shape, with the bottom of each notch sloping towards the inside of the receptacle. Level with the lock notches 6, the rim 3 includes indentations 7.

According to the invention, the bathing device also includes a platform given overall reference 8, comprising a bottom 9 perforated with holes 10. The length and the width of the platform 8 are slightly less than the corresponding dimensions of the receptacle 1, such that the external periphery of the platform can be fitted inside the internal periphery of the receptacle and can be raised to a desired height by placing lugs 12 in the indentations 7. The platform 8 includes a rim 11 projecting upwardly from its bottom 9. This rim is to prevent the baby from sliding or rolling off the platform. The lugs 12 are in the form of downwardly facing hooks and extend horizontally outwardly from a top edge of the platform rim 11. The lugs 12 are complementary in shape to the guide grooves 5 in the side wall 2 of the receptacle and are disposed along the long sides of the platform 8 so as to be suitable for engaging in the guide grooves 5. The bottom faces of the hooking lugs 12 include lock ribs 13 which are in triangular cross-section (FIG. 2) with the free end of the rib 13 facing the inwardly inclined face of the corresponding lock notch 6 of the receptacle side wall 2.

The base of the platform 8 includes legs 14. The legs are close to the ends of the platform and include slots 15, e.g. in the form of an upsidedown L-shape, in which a closed-loop lifting strap 16 is received.

Close to one end, the bottom 9 of the platform 8 is raised to form a back piece 17 and another means 18, e.g. openings through the wall of the platform, are provided in the vicinity of the back piece 17 in order to receive a fixing strap 19.

At its end opposite to the back piece 17, the platform 8 includes an indentation 20 for giving access to the water in the receptacle and also to a plug 21 for emptying purposes.

To one end of the receptacle 1, the device includes a padded mat 22 having an edge which is raised in order to pivot relative to one of the ends of the receptacle.

For example, the mat 22 may be made of foam and may be fixed to the rim of the receptacle by rivets 23, with the flexibility of the mat enabling it to pivot relative to the edge of the receptacle between a position in which it hangs vertically, as shown in FIG. 1, and a position in which it extends horizontally over the receptacle.

FIG. 4 shows a variant embodiment in which the receptacle includes a series of a support notches 24 extending longitudinally from one of the sides of each guide groove 5, with each support notch 24 additionally including its own rim 25. In this case, the hook portions of the lugs 12 are omitted.

In use, the platform 8 is initially disposed so that it bears against the top rim of the receptacle with the locking ribs 13 engaged in the lock grooves 6, and the hooks of the lugs 12 engaged in the indentations 7. In this position, the platform 8 is held in stable manner both in the longitudinal direction and in the transverse direction, and it is therefore possible to place a baby on the platform, for example for undressing purposes. If it is desired to improve the comfort of the platform in this position, the padded mat 22 may simultaneously be folded down onto the platform. If the hands are to be left completely free thereafter, it is also possible to strap the baby into a sitting position by means of a strap 19. In order t immerse the baby, all that needs to be done is to raise the platform by taking the two lengths of strap 16 in one hand and then causing the lugs 12 to engage the guide grooves 5, and thereafter lower the platform into the liquid which has previously been put into the receptacle. The water penetrates through the holes 10 and wets the baby which, if held in place by means of the strap 19 can be allowed to play with the water without there being any risk of slipping into it, with the platform being restrained when in the low position both in the longitudinal direction and in the transverse direction.

In order to dry the baby after a bath, the reverse operation is performed with the platform and it can be seen that as the platform is raised water runs off the baby and off the platform and falls back into the receptacle, thereby avoiding wetting the space surrounding the bath receptacle. In addition, the platform is easily moved using one hand only such that the other hand remains available, for example for holding the baby's head if the baby is not attached to the platform. The variant embodiment shown in FIG. 4 allows the platform to be held in intermediate positions depending on the desired degree of immersion. It may also be observed that if it is desired to rinse the soap off the baby using a shower, then raising the platform 8 to the high position suffices to ensure that the water will run off as it is showered onto the baby.

The structures of the receptacle and of the platform are such that each of them is suitable for being made by molding plastic material. Naturally, any other desired material and method of manufacture appropriate to the material could be used. In particular, if so desired, the platform 8 could be made of a material having a density which is less than that of water, and removable ballast members could then be provided in order to hold the platform in the immersed position. If so desired, the bottom of the platform may be covered with a perforated padded lining.

Naturally, the invention is not limited to the above-described embodiments, and variants may be applied thereto without going beyond the scope of the invention. In particular, the internal periphery of the receptacle and the external periphery of the platform may be of arbitrary shape provided the external periphery of the platform fits inside the internal periphery of the receptacle in a given position, and provided at least some portions of said peripheries are complementary in order to ensure that the platform is stable when in its low position or at any other possible level. Similarly, the lifting means could be in the form of rigid handles hinged to the platform in a longitudinal or a transverse direction relative thereto, or they could be provided by separate straps fixed on either side of the platform. If so desired, the padded lining may be made waterproof by means of a waterproof cover.

It will also have been observed that in the FIG. 1 embodiment, the notches 6 and the indentations 7 which are respectively associated with the lock ribs 13 and the hook portions of the lugs 12 also serve for holding the platform in a longitudinal direction which it is in the high position. The ribs thus serve both for locking purposes and for reinforcing the connection between each lug 12 and the rim 11 of the platform. If so desired, the lugs 12 could be plane and the cut-outs 7 could be omitted. In the case shown in FIG. 4, it is assumed that the platform-constituting material is strong enough for the lugs 12 to have no need for ribs 13. The support notches 24 therefore do not include notches analogous to the notches 6. Naturally, if it is desired to reinforce the lugs with ribs 13, then such notches would need to be provided.

The receptacle may also be fitted with taps for delivering water and various accessories such as a soap-holder. In addition, the receptacle may be a bottomless receptacle which acts merely as a support suitable for placing, for example, in a standard bathtub. The side wall of the receptacle then delimits a volume of water into which the platform is lowered.

Although the invention has been described more particularly with respect to bathing babies, it will be understood that the device may also be used for bathing handicapped adults, in which case the materials used must naturally be selected for providing adequate strength.

We claim:

1. An infant bathing device comprising (a) a rigid receptacle having a bottom, an opened top with a rim and side walls, wherein at least two facing side walls have interior vertically contoured surface portions;

(b) a rigid platform means for supporting an infant in a sitting and reclined position and having a perforated bottom and being configured such that the platform is vertically movable within the entire receptacle while being in a substantially horizontal plane;

(c) an entire rigid periphery of the platform wherein the periphery has at least some periphery contoured portions which are contoured substantially opposite to and engagable within the said receptacle contoured surface portions, whereby the periphery contoured portions are vertically slidable in the said receptacle contoured surface portions so that the platform is vertically movable to any vertical position within the receptacle while being in a substantially horizontal plane and whereby the platform can be vertically moved to the top of the receptacle and the said contoured portions horizontally offset so that the platform is supportable by the said rim; and (d) lifting means associated with the platform for vertically moving the platform.

2. A bathing device according to claim 1, characterized in that the receptacle contoured surface portions are in the form of guide grooves (5), and in that the said periphery contoured portions are in the form of projecting members (12) configured to be engagable in the guide grooves (5).

3. A bathing device according to claim 2, characterized in that the guide grooves (5) include support notches 924) extending laterally from one of the sides of each of the guide grooves (5).

4. A bathing device according to claim 2, characterized in that its side wall have a top edge including lock notches (6) and in that the projecting members (12) of the platform include lock ribs (13) disposed to engage in the lock notches.

5. A bathing device according to claim 4, characterized in that the lock ribs (13) and notches (6) are triangular in crosssection.

6. A bathing device according to claim 2, characterized in that the projecting members (12) are in the form of downwardly directed hooks.

7. A bathing device according to claim 1, characterized in that the platform includes a rim (11) extending upwardly from the bottom (9).

8. A bathing device according to claim 1, characterized in that the platform includes legs (14), and in that the lifting means includes a strap (16) engaged in slots (15) provided in said legs.

9. A bathing device according to claim 1, characterized in that the platform (8) includes a raised end (17) providing a back piece.

10. A bathing device according to claim 9, characterized in that the back-piece forming end of the platform includes anchor points (18) for a retaining strap (19).

11. A bathing device according to claim 1, characterized in that the receptacle includes a plug (21) and in that the platform (8) includes an indentation (20) giving access to the plug.

12. A bathing device according to claim 1, characterized in that it includes a padded member having one side pivotally mounted relative to one of the sides of the receptacle.

* * * * *